US009693601B2

(12) United States Patent
Riddle et al.

(10) Patent No.: US 9,693,601 B2
(45) Date of Patent: Jul. 4, 2017

(54) FOOTWEAR WITH ZONED INSULATION

(71) Applicant: CABELA'S INCORPORATED, Sidney, NE (US)

(72) Inventors: Michael Thomas Riddle, Sidney, NE (US); Brian Charles Fort, Sidney, NE (US); Andrew Donavan Sircy, Sidney, NE (US); Colton Lee Thomas, Sidney, NE (US)

(73) Assignee: CABELA'S INCORPORATED, Sidney, NE (US)

( * ) Notice: Subject to any disclaimer, the term of this patent is extended or adjusted under 35 U.S.C. 154(b) by 0 days.

(21) Appl. No.: 14/938,328

(22) Filed: Nov. 11, 2015

(65) Prior Publication Data

US 2017/0127754 A1 May 11, 2017

(51) Int. Cl.

| | |
|---|---|
| ***A43B 23/07*** | (2006.01) |
| ***A43B 7/34*** | (2006.01) |
| ***A43B 3/02*** | (2006.01) |
| ***A43B 7/12*** | (2006.01) |

(52) U.S. Cl.

CPC ..... *A43B 7/34* (2013.01); *A43B 3/02* (2013.01); *A43B 7/12* (2013.01); *A43B 23/07* (2013.01)

(58) Field of Classification Search

CPC ..... A43B 5/0405; A43B 23/07; A43B 23/026
USPC ..... 36/10, 55
See application file for complete search history.

(56) References Cited

U.S. PATENT DOCUMENTS 2,003,105 A * 5/1935 Caplan ..... A43B 19/00 12/142 Q
2,077,121 A * 4/1937 Lovell ..... A43B 23/0255 12/142 R
2,578,987 A * 12/1951 Schultz ..... A43B 7/32 36/55
2,724,676 A * 11/1955 Randall ..... A43B 3/02 12/142 E
2,814,888 A * 12/1957 Hill ..... A43B 23/082 36/77 R
3,419,974 A * 1/1969 Lange ..... A43B 1/0018 12/142 R
3,858,337 A * 1/1975 Vogel ..... A43B 5/0405 36/117.6
4,038,762 A 8/1977 Swan, Jr.
4,249,319 A * 2/1981 Yoshida ..... A43B 7/02 36/10
4,433,494 A * 2/1984 Courvoisier ..... A42B 3/125 2/420
4,455,764 A 6/1984 Rock et al.
4,658,515 A 4/1987 Oatman
(Continued)

*Primary Examiner* — Marie Bays
(74) *Attorney, Agent, or Firm* — Quarles & Brady LLP

(57) ABSTRACT

Footwear and a method of manufacture of footwear are presented. The footwear has different insulation zones and each zone has a different level of insulation. For example, an article of footwear includes a first insulation zone, a second insulation zone, and a third insulation zone. The first, second, and third insulation zones each provide a different level of insulation for a specific part of a wearer's foot. The first insulation zone may be the heel region of the article of footwear, the second insulation zone may be the main part of the foot region of the article of footwear excluding both the heel region and a toe region of the article of footwear, and the third insulation zone may be the toe region of the article of footwear.

7 Claims, 9 Drawing Sheets

(56) References Cited

U.S. PATENT DOCUMENTS

| | | | | |
|---|---|---|---|---|
| 5,289,645 | A * | 3/1994 | Marega | A43B 5/0405 36/10 |
| 5,778,565 | A | 7/1998 | Holt et al. | |
| 5,802,740 | A | 9/1998 | Merk | |
| 6,260,288 | B1 * | 7/2001 | Barthelemy | A43B 7/06 36/3 R |
| 6,305,101 | B2 * | 10/2001 | Chemello | A43B 5/0496 36/10 |
| 7,055,267 | B2 * | 6/2006 | Wilson | A43B 7/08 36/10 |
| 7,603,796 | B2 * | 10/2009 | Johnson, Jr. | A43B 7/32 36/72 R |
| 7,752,776 | B2 | 7/2010 | Farnworth | |
| 8,479,322 | B2 * | 7/2013 | Blackford | A41D 31/0038 2/272 |
| 9,380,831 | B2 * | 7/2016 | Craig | A41B 11/02 |
| 2003/0070323 | A1 * | 4/2003 | Johnson, Jr. | A43B 7/32 36/77 R |
| 2003/0097768 | A1 * | 5/2003 | Baek | A43B 5/0405 36/55 |
| 2007/0094892 | A1 * | 5/2007 | Craig | A41B 11/02 36/10 |
| 2007/0128391 | A1 * | 6/2007 | Giacobone | A41D 31/0038 428/35.7 |
| 2015/0289589 | A1 * | 10/2015 | Nishiwaki | A43B 23/028 36/92 |
| 2016/0295962 | A1 * | 10/2016 | Craig | A41B 11/02 |

* cited by examiner

FOOTWEAR WITH ZONED INSULATION

BACKGROUND

Insulation can be used to increase warmth in many different articles of clothing or footwear. In boots designed to be worn in cold and wet conditions, for example, increased amounts of insulation may keep the wearer's feet warm.

Varying amounts of insulation in a type of footwear may be indicated by a weight, for example in grams. More insulation (i.e., a greater weight of insulation) generally provides enhanced insulation and greater warmth.

When insulating footwear designed for vigorous activities, such as hiking or hunting, the amount of insulation can be an important consideration—too much insulation may cause the wearer's foot to overheat and perspire, resulting in blisters and potential injury, while too little insulation may cause the wearer's foot to become cold.

When designing conventional footwear, the goal is to generally provide the footwear with a target overall level or weight of insulation. Footwear designed for colder weather activities will have a greater weight of insulation, whereas footwear for warmer activities will generally have a lighter weight of insulation. This approach, though, fails to consider that different regions of the foot may be better suited to different levels of insulation.

BRIEF DESCRIPTION OF THE DRAWINGS

The detailed description is set forth with reference to the accompanying figures. The use of the same reference numbers in different figures indicates similar or identical items or features.

DETAILED DESCRIPTION

In various embodiments described herein, different types of footwear include insulation for keeping a wearer's foot warm. In some embodiments, the footwear may have different zones where each zone has a different level of insulation. For example, the footwear may be a boot with three different insulation zones that each provide a different level of insulation for a specific part of a wearer's foot. For example, the first insulation zone may be the heel region, the second insulation zone may be the main part of the foot region excluding the heel region and the toe region, herein labeled as the saddle region. The third insulation zone may be the toe region. The different zones may each provide a different level of cold protection. For example, the zone of the heel region may have a lower level of insulation than the zone of the saddle region. The zone of the saddle region, may in turn, have a lower level of insulation than the zone of the toe region.

Figure 1:
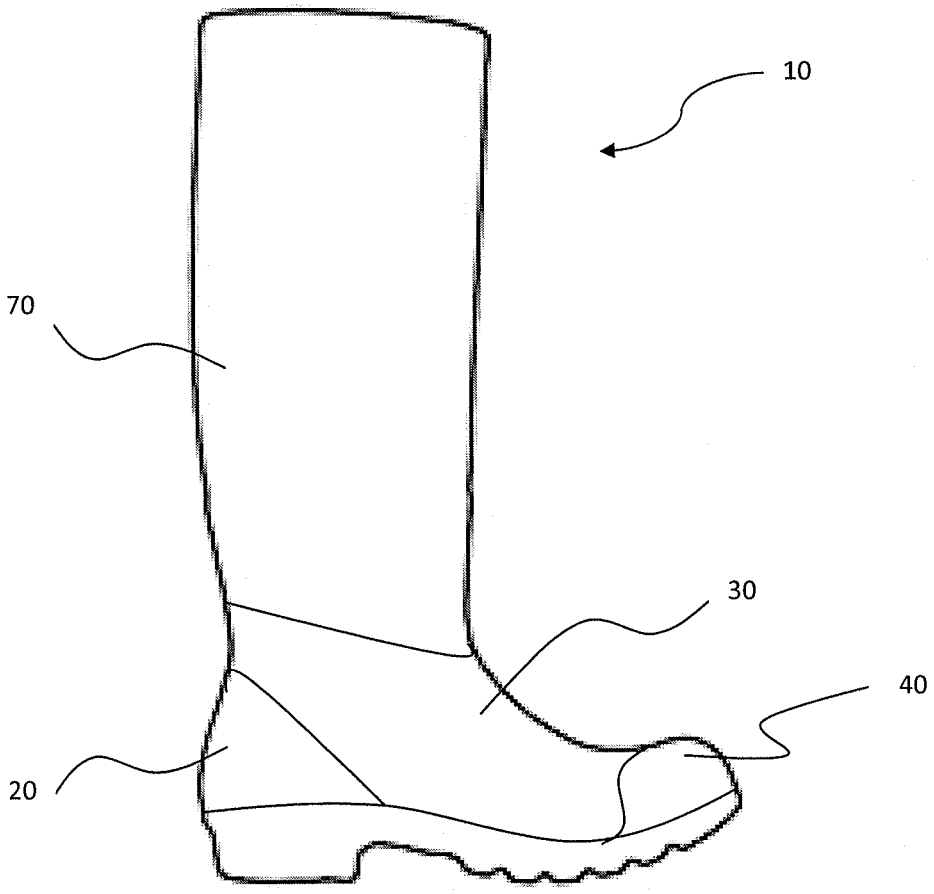
FIG. 1 illustrates a side view of a boot with zoned insulation, according to an embodiment.
Figure 2:
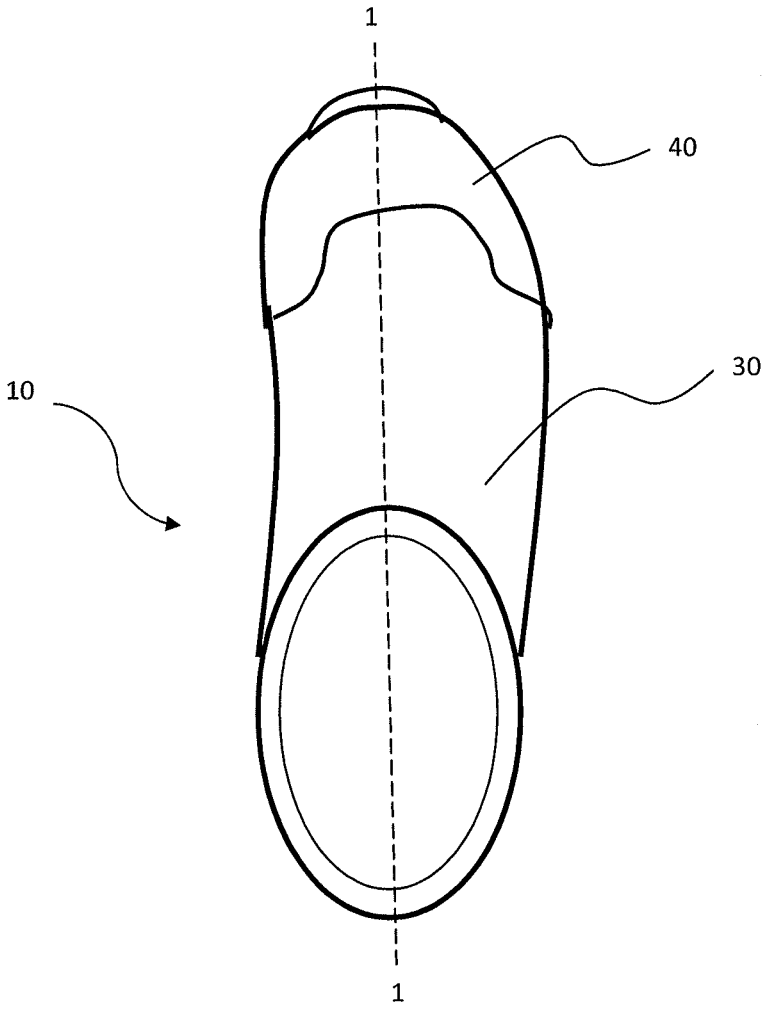
FIG. 2 illustrates a top view of a boot with zoned insulation, according to an embodiment.

FIG. 1 is a side view of a boot 10. According to an embodiment, boot 10 may be divided into different insulation zones. Each insulation zone may provide a specific level of insulation for a particular part of a wearer's foot. For example, the heel region zone 20, the main foot, or saddle region zone 30, and the toe region zone 40, may each provide a different and specific level of insulation. The level of insulation may be indicated by the weight of the insulation used, for example, in grams. The heel region zone 20 of boot 10 may, as an example, have an insulation level of 200 grams. The saddle region zone 30 of boot 10 may, as an example, have an insulation level of 400 grams. The toe region zone 40 of boot 10 may, as an example, have an insulation level of 800 grams. FIG. 2 provides a top view of boot 10 which shows a top view of the saddle region zone 30 and the toe region zone 40. In the present disclosure a number of example embodiments are present with reference to footwear that includes a boot, such as a boot having a waterproof outer layer. It will be appreciated, however, that the zoned insulation configuration disclosed herein may be applicable and incorporated into other types of footwear, such as hiking boots, hiking shoes, cross-trainers, slippers, boots of waders, and the like.

The different insulation zones may be selected based on an analysis and refinement of existing boot constructions that include a single layer of insulation having a consistent-thickness throughout the entire boot. The size of each insulation zone may then be further refined by reducing the amount of insulation in areas requiring less insulation, for example in the heel region zone. The target insulation level for each different zone may be determined by taking into consideration the overall insulation value based on sales history and proven performance of traditional insulated footwear. For example, the insulation amount in each zone may be selected so that an average amount of insulation over the entire boot is about equal to that found in a conventional insulated boot. Once the highest overall insulation value is determined, the different insulation zones with lower insulation values may be determined by incrementally stepping down or decreasing from the highest value. For example, the toe region zone may contain the highest overall insulation level, and the saddle region zone may be determined by incrementally stepping down or decreasing from the insulation level of the toe region zone. Further, the heel region zone may be determined by incrementally stepping down or decreasing from the insulation level of the saddle region zone.

Figure 3:
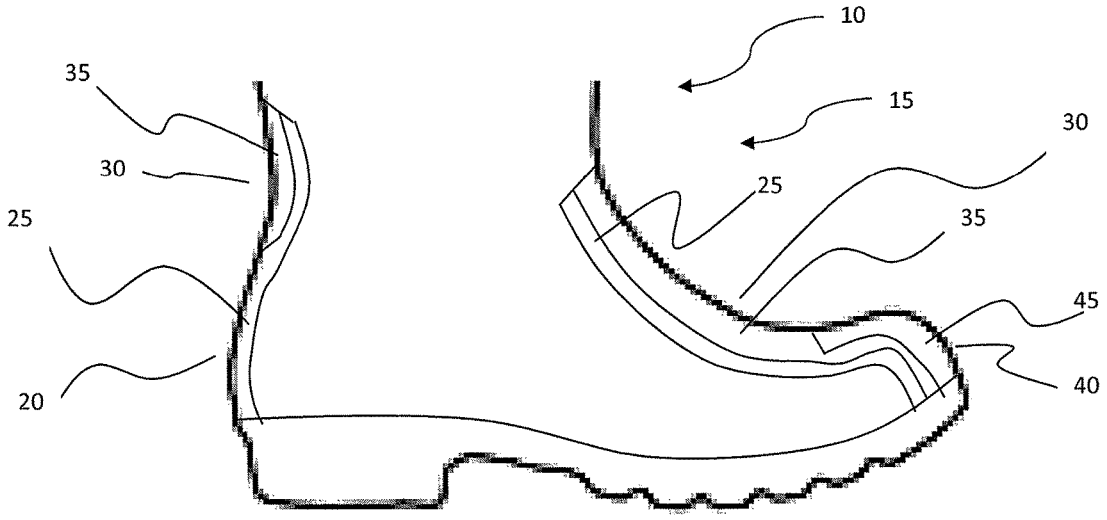
FIG. 3 illustrates a cross-section view of a boot with zoned insulation, according to an embodiment.

In one implementation, the different zones, each with a different level of insulation, may be created by using layers of insulation. FIG. 3 is a cross-section view of boot 10 taken along line 1-1 of FIG. 2, and only showing the lower portion 15 of boot 10. For example, first insulation layer 25 may be included in each zone. First insulation layer 25 may have an insulation level of 200 grams. The heel region zone 20 therefore has an insulation level of 200 grams as first insulation layer 25 is the only layer included in the heel region zone 20, as shown in FIG. 3. Second insulation layer 35 may be included in both the saddle region zone 30 and the toe region zone 40. Second insulation layer 35, may, for example, have an insulation level of 200 grams. The combination of the first and second insulation layers 25 and 35 provide an insulation level of 400 grams in the saddle region zone. Third insulation layer 45 may, for example, have an insulation level of 400 grams. As the third layer is only included in the toe region zone 40, the combined insulation level of the toe region zone 40 is 800 grams (combination of first, second, and third insulation layers 25, 35, 45).

This implementation provides the benefit of different insulation levels for different parts of a wearer's foot, which results in improved functionality of the footwear. The lower insulation level in the heel region zone 20 decreases the possibility of overheating and perspiration and the chance that a wearer's heel will slip while the wearer is participating in vigorous activity, thereby decreasing the possibility that the wearer will develop blisters or other injury to the heel region of their foot. Meanwhile, the increased level of insulation provided in the saddle region of a wearer's foot decreases the possibility that the main part of wearer's foot will become cold; and the highest level of insulation in the toe region zone 40 ensures that the relatively heat-sensitive toe region of a wearer's foot remains warm.

Figure 4:
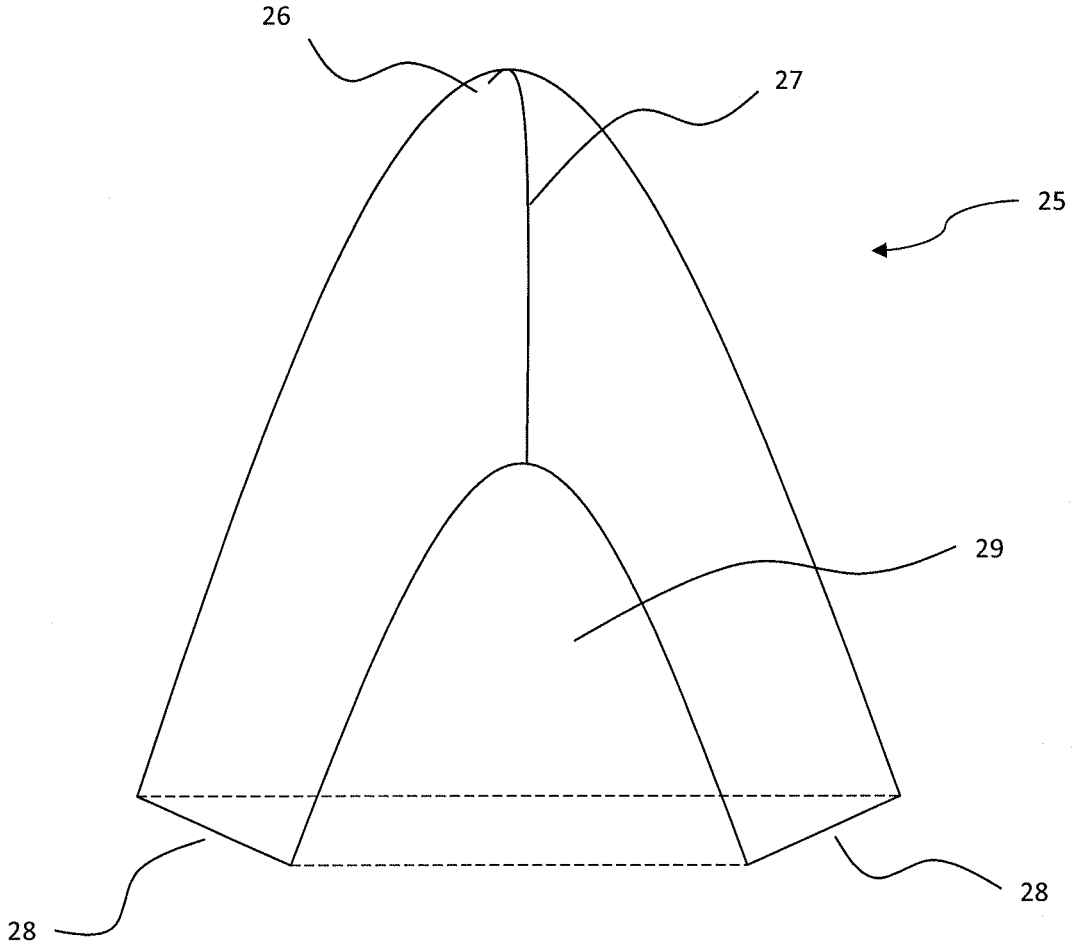
FIG. 4 illustrates a top view of a first layer of insulation pre-installation, according to an embodiment.
Figure 5:
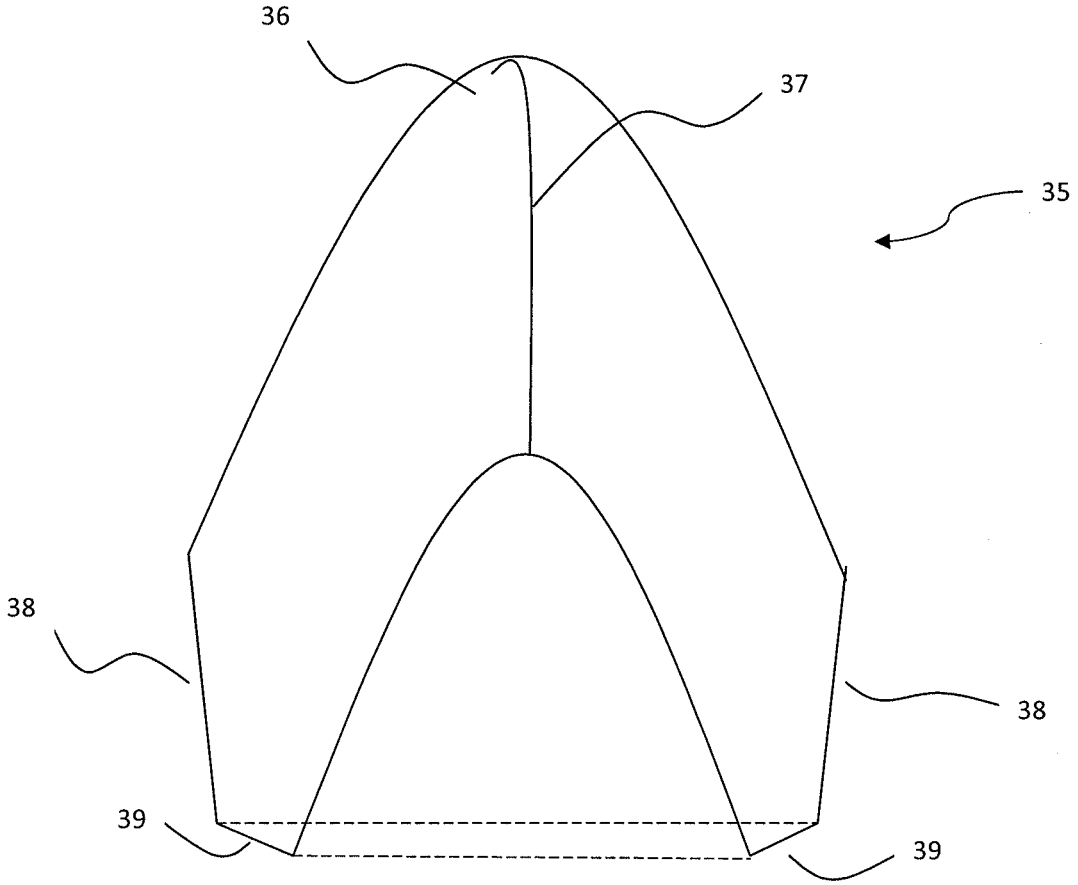
FIG. 5 illustrates a top view of a second layer of insulation pre-installation, according to an embodiment.
Figure 6:
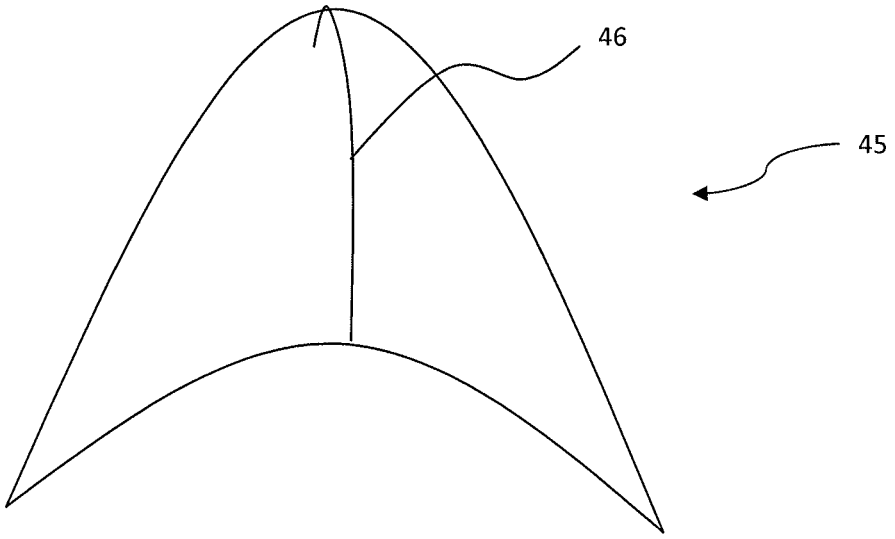
FIG. 6 illustrates a top view of a third layer of insulation pre-installation, according to an embodiment.

According to an embodiment, FIGS. 4-6 show a top view of the different individual insulation layers pre-installation, i.e., before they are inserted or built into the footwear. Any lofted insulation material that can be formed into sheets and then cut to specific sizes and shapes may be used for the individual insulation layers. For example, brands such as Primaloft, Thermoloft, or Thinsulate may all meet this requirement. FIG. 4 provides a top view of the first insulation layer 25, which may comprise two pieces of insulation connected via a stitching line 27. The stitching line 27 may be stitched in such a manner that the toe section 26 of the first insulation layer 25 is formed into a convex shape that aids in conforming the insulation layer to the shape of the footwear. Similarly, the stitching line 37 of the second insulation layer 35 may perform the same function, forming the toe region 36 of the second insulation layer 35 into a convex shape, as shown in FIG. 5. The insulation layer geometry may be determined by use of a last (or foot form) in conjunction with the shape and size of the outsole of the footwear.

Figure 9:
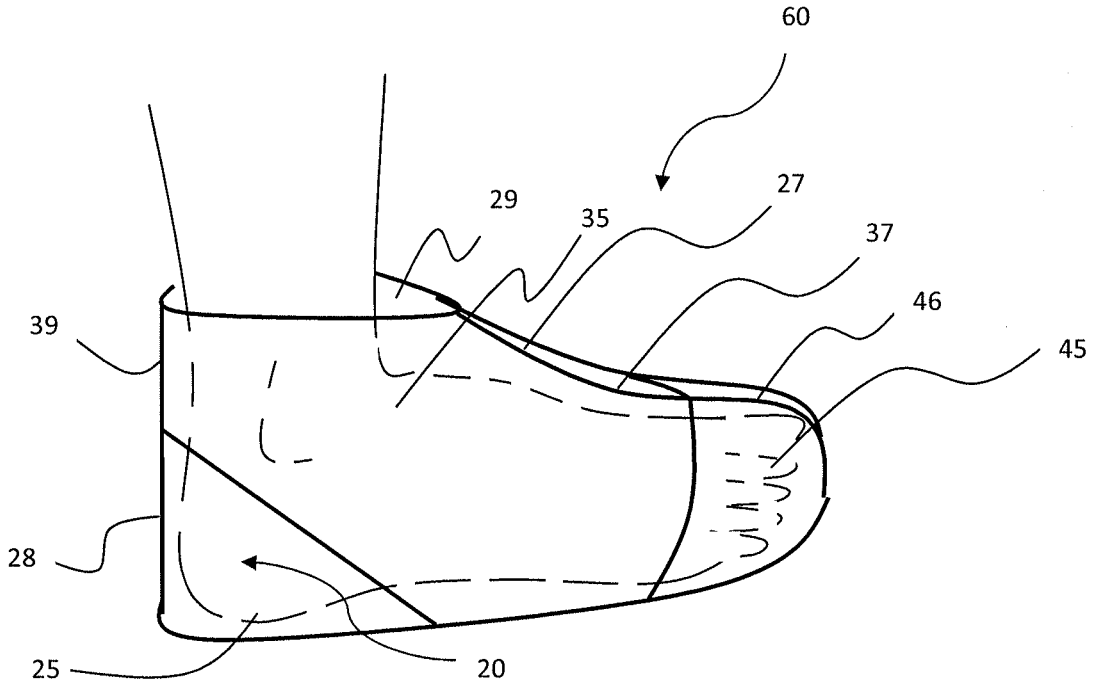
FIG. 9 illustrates a view of a combination of three layers of insulation positioned over a last (foot form), according to an embodiment.

When ends 28 of the first insulation layer 25 are connected together at the points indicated by the dashed lines, the first insulation layer 25 is formed into the shape of the foot-covering top portion of an article of footwear. When ends 28 are connected, the first insulation layer 25 has an opening 29 that matches the opening in an item of footwear in which a wearer inserts their foot. FIG. 9 shows the first insulation layer 25 positioned over a last 60, with the second and third insulation layers 35, 45 positioned over the first insulation layer 25. In FIG. 9, ends 28 of the first insulation layer 25 are connected together and a last 60 is inserted through opening 29. The individual layers may be sewn together using a quilted pattern to help keep them together during the manufacturing and assembly processes. The stitched package may be tightly formed over a last in order to ensure complete and consistent insulation coverage.

FIG. 5 shows a top view of the second insulation layer 35. According to an embodiment, the second insulation layer 35 does not provide any insulation in the heel region zone 20 when ends 39 are connected together. In FIG. 9 the second insulation layer 35 has ends 39 connected together. The second insulation layer 35 does not cover heel region zone 20, thus the only insulation provided to heel region zone 20 is provided by the first insulation layer 25.

FIG. 6 provides a top view of the third insulation layer 45, which may comprise two pieces of insulation connected via a stitching line 46. The stitching line 46 may be stitched in such a manner that the majority of the third insulation layer is formed into a convex shape, such that the shape aids in conforming the insulation layer to the shape of the toe area of an item of footwear. FIG. 9 shows the third insulation layer 45 attached to the first and second insulation layers 25, 35 and positioned over a last 60.

Figure 7:
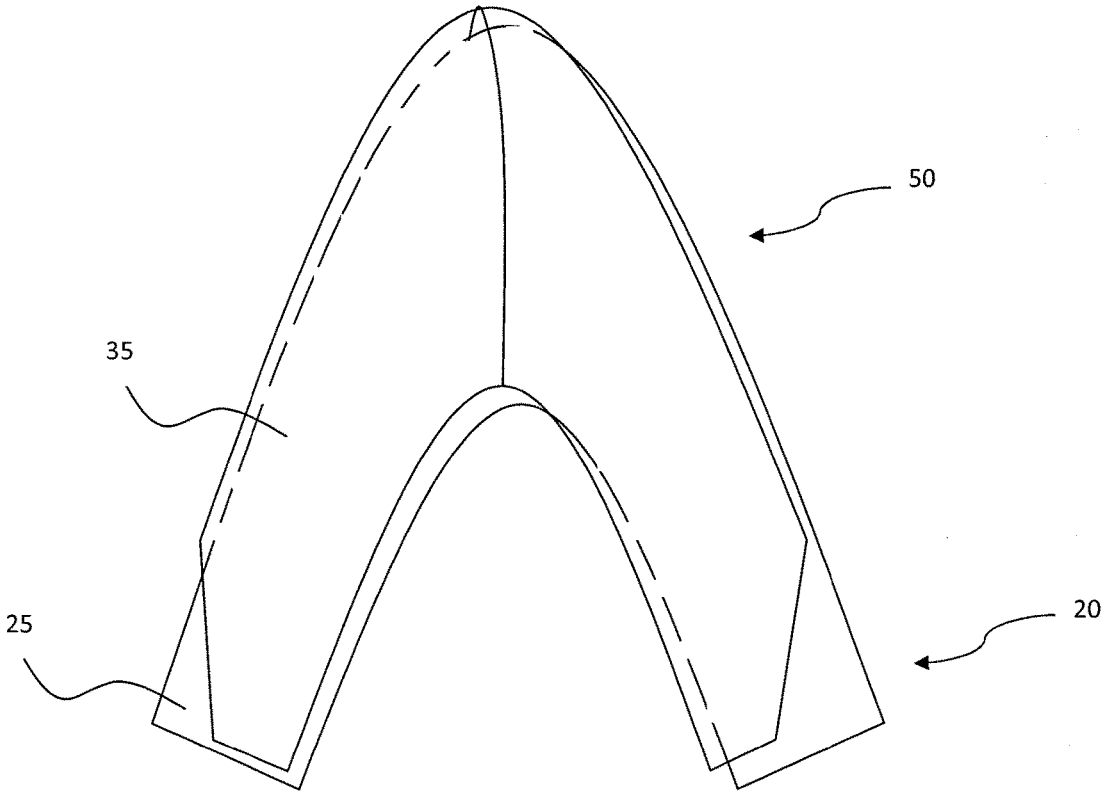
FIG. 7 illustrates a top view of a combination of two layers of insulation pre-installation, according to an embodiment.

In one implementation, the first and second insulation layers are combined to create two different insulation zones, as shown in FIG. 7. First insulation layer 25 and second insulation layer 35 are shown slightly offset in order to demonstrate the two separate layers. First insulation layer 25 and second insulation layer 35 combine together to form two distinct insulation zones 20 and 50. For example, in one embodiment, first insulation layer 25 may have an insulation weight of 200 grams, and second insulation layer 35 may also have an insulation weight of 200 grams. The combination of the first insulation layer 25 and the second insulation layer 35 results in insulation zone 50 which provides an insulation level of 400 grams to the saddle region and the toe region of a wearer's foot. The absence of insulation material of the second insulation layer 35 in the heel zone 20 results in a level of insulation of 200 grams for a wearer's heel region.

Figure 8:
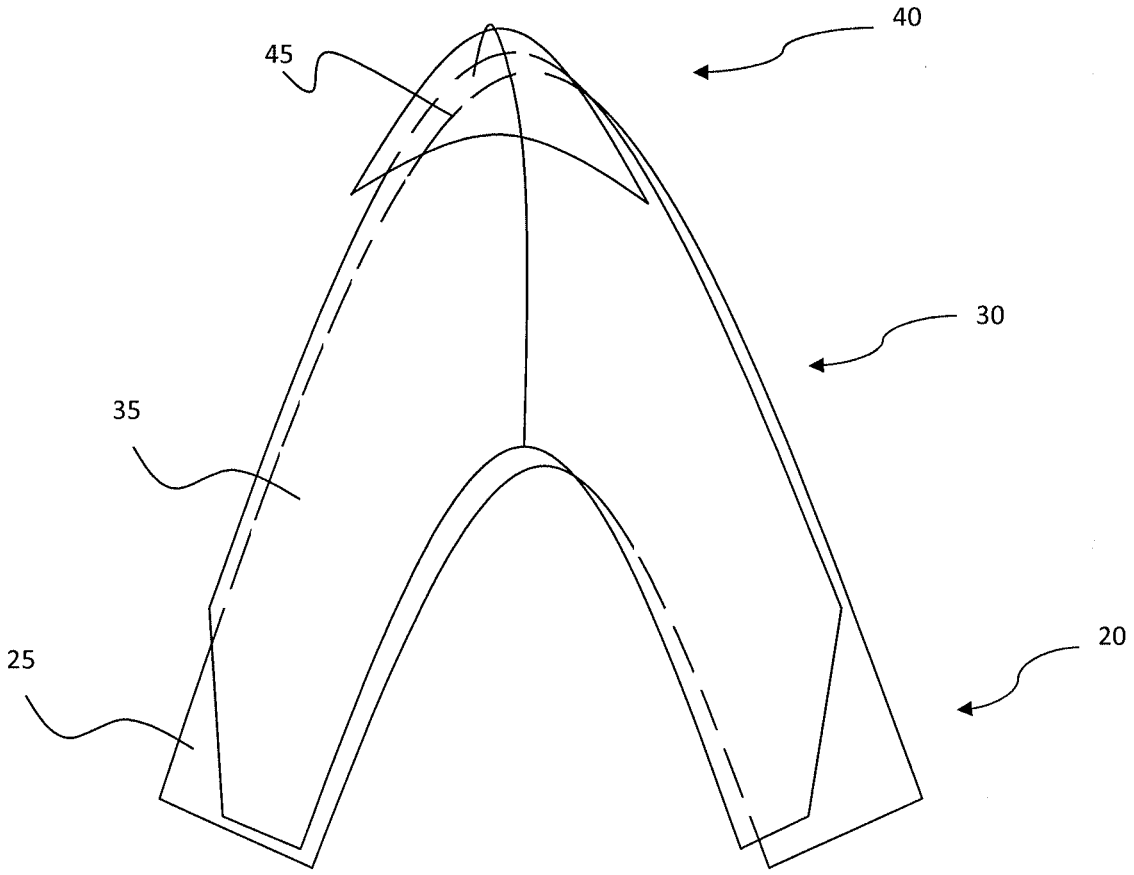
FIG. 8 illustrates a top view of a combination of three layers of insulation pre-installation, according to an embodiment.

In another implementation, the first, second, and third insulation layers are combined to create three different insulation zones, as shown in FIG. 8. In FIG. 8 first insulation layer 25, second insulation layer 35, and third insulation layer 45 are shown slightly offset in order to demonstrate the three separate layers. First insulation layer 25, second insulation layer 35, and third insulation layer combine together to form three distinct insulation zones 20, 30, and 40. For example, in one embodiment, first insulation layer 25 may have an insulation weight of 200 grams, second insulation layer 35 may also have an insulation weight of 200 grams, and third insulation layer 45 may have an insulation weight of 400 grams. The heel region zone 20 has an insulation weight of 200 grams, the saddle region zone 30 has an insulation weight of 400 grams, and the toe region zone 40 has in insulation weight of 800 grams.

Prior to final assembly, the individual insulation layers may be stitched together, as previously described. The pre-assembly of the insulation layers ensures that the middle layer of insulation, or second insulation layer 35, does not become bunched between the other two layers, 25 and 45. Once the pre-assembled insulation layers are in place, specific rubber panels are assembled over the insulation layers for completing the manufacture of the footwear.

In another embodiment, boot 10, as shown in FIG. 1, may also include a shaft region zone 70 in addition to the heel region zone 20, the saddle region zone 30, and the toe region zone 40. The shaft region zone 70 may be located above the ankle area of the boot. Each different insulation zone may provide a specific level of insulation for a particular part of a wearer's foot or leg. For example, the toe region zone 40 may have the highest level of insulation and the insulation levels may decrease for each subsequent zone such that the shaft region zone 70 has the lowest level of insulation. For instance, the saddle region zone 30 may have the second highest level of insulation, the heel region zone 20 may have the third highest level of insulation, and the shaft region zone 70 may have the lowest level of insulation.

Alternatively, the progression of increasing insulation could start at the shaft region zone 70 and the insulation level could decrease with each preceding zone. For example, the shaft region zone 70 may have the highest level of insulation, the heel region zone 20 may have the second highest level of insulation, the saddle region zone 30 may have the third highest level of insulation, and the toe region zone 40 may have the lowest level of insulation.

In yet another embodiment, there may not be a progression of increasing or decreasing insulation levels, but rather one or more specific zones may have the highest level of insulation. For example, the saddle region zone 30 may have the highest insulation level of boot 10, as shown in FIG. 1, with the other zones having lower insulation levels. Alternatively, the heel region zone 20 and the toe region zone 40 may have equal insulation levels, which is also the highest insulation level incorporated within the boot, with the saddle region zone 30 and shaft region zone 70 having lower insulation levels.

The plurality of insulation zones and the corresponding insulation levels can be varied depending on the desired application for the footwear. One skilled in the art will realize that a virtually unlimited number of variations to the above descriptions are possible, and that the examples and the accompanying figures are merely to illustrate one or more examples of implementations Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

It will be understood by those skilled in the art that various other modifications may be made, and equivalents may be substituted, without departing from claimed subject matter. Additionally, many modifications may be made to adapt a particular situation to the teachings of claimed subject matter without departing from the central concept described herein. Therefore, it is intended that claimed subject matter not be limited to the particular embodiments or implementations disclosed, but that such claimed subject matter may also include all embodiments or implementations falling within the scope of the appended claims, and equivalents thereof.

In the detailed description above, numerous specific details are set forth to provide a thorough understanding of claimed subject matter. However, it will be understood by those skilled in the art that claimed subject matter may be practiced without these specific details. In other instances, methods, apparatuses, or systems that would be known by one of ordinary skill have not been described in detail so as not to obscure claimed subject matter.

Reference throughout this specification to "one embodiment," "an embodiment," "one implementation," or "an implementation" may mean that a particular feature, structure, or characteristic described in connection with a particular embodiment or implementation may be included in at least one embodiment or implementation of claimed subject matter. Thus, appearances of the phrase "in one embodiment," "an embodiment," "one implementation," or "an implementation" in various places throughout this specification are not necessarily intended to refer to the same embodiment or implementation, or to any one particular embodiment or implementation described. Furthermore, it is to be understood that particular features, structures, or characteristics described may be combined in various ways in one or more embodiments or implementations. In general, of course, these and other issues may vary with the particular context of usage. Therefore, the particular context of the description or the usage of these terms may provide helpful guidance regarding inferences to be drawn for that context.

What is claimed is:

1. An article of footwear having a first insulation zone, a second insulation zone, and a third insulation zone, the article of footwear comprising:

a first layer of insulation materials disposed throughout the first insulation zone, the second insulation zone, and the third insulation zone, the first layer of insulation having a first insulation level;

a second layer of insulation materials disposed throughout the second insulation zone and the third insulation zone and not being disposed in the first insulation zone, the second layer of insulation having a second insulation level;

a third layer of insulation materials disposed throughout the third insulation zone and not being disposed in the first insulation zone or the second insulation zone, the third layer having a third insulation level, so that the first insulation zone has an insulation level equal to the first insulation level, the second insulation zone has an insulation level equal to the combination of the first and second insulation levels and the third insulation zone has an insulation level equal to the combination of the first, second, and third insulation levels; and wherein the first insulation zone includes a heel region of the footwear, the second insulation zone includes a main foot region of the article of footwear excluding both the heel region and a toe region of the article of footwear, and the third insulation zone includes the toe region of the article of footwear.

2. The article of footwear recited in claim 1, wherein the first layer of insulation, the second layer of insulation, and the third layer of insulation are joined together by stitching.

3. The article of footwear recited in claim 1, wherein the first layer of insulation, the second layer of insulation, and the third layer of insulation include a lofted insulation material.

4. The article of footwear recited in claim 1, wherein the first insulation level is 200 grams, the second insulation level is 200 grams, and the third insulation level is 400 grams, so that the first insulation zone has an insulation level of 200 grams, the second insulation zone has an insulation level of 400 grams, and the third insulation zone has an insulation level of 800 grams.

5. The article of footwear recited in claim 1, wherein the first insulation level is 1,200 grams, the second insulation level is 400 grams, and the third insulation level is 400 grams, so that the first insulation zone has an insulation level of 1,200 grams, the second insulation zone has an insulation level of 1,600 grams, and the third insulation zone has an insulation level of 2,000 grams.

6. The article of footwear recited in claim 1, wherein the first insulation level is 400 grams, the second insulation level is 400 grams, and the third insulation level is 400 grams, so that the first insulation zone has an insulation level of 400 grams, the second insulation zone has an insulation level of 800 grams, and the third insulation zone has an insulation level of 1,200 grams.

7. The article of footwear recited in claim 1, wherein the article of footwear is a boot including a waterproof outer layer.

* * * * *